United States Patent [19]

Uchida

[11] Patent Number: 4,946,302

[45] Date of Patent: Aug. 7, 1990

[54] LIQUID APPLICATOR WITH RESILIENT BRUSH MOUNTING

[75] Inventor: Masaki Uchida, Fujioka, Japan

[73] Assignee: Mitsubishi Pencil Co., Ltd., Tokyo, Japan

[21] Appl. No.: 450,956

[22] Filed: Dec. 15, 1989

[30] Foreign Application Priority Data

Jan. 31, 1989 [JP] Japan ..... 11084[U]

[51] Int. Cl.[5] ..... A46B 11/00

[52] U.S. Cl. ..... 401/288; 401/54; 401/273; 401/290

[58] Field of Search ..... 401/288, 290, 273, 54

[56] References Cited

U.S. PATENT DOCUMENTS

| | | | |
|---|---|---|---|
| 1,769,206 | 7/1930 | Coady | 401/288 |
| 2,287,321 | 6/1942 | Mureau | 401/290 X |
| 4,364,684 | 12/1982 | Kohno et al. | 401/273 X |

*Primary Examiner*—Steven A. Bratlie

*Attorney, Agent, or Firm*—Armstrong, Nikaido Marmelstein, Kubovcik & Murray

[57] ABSTRACT

In a liquid applicator comprising: a main body or shaft sleeve; a front shaft provided with at least one inner shoulder portion, the front shaft being fixedly mounted on the shaft sleeve; a brush tip for applying an application liquid, which brush tip has its rear-end portion formed into a solid flange portion, the brush tip being constructed of a tuft of fibers while mounted in the front shaft so as to extend forward from the front shaft; and a pipe-connecting piece provided with an axial through-hole in its central portion, in which through-hole is fixedly mounted a guide pipe for supplying the application liquid from the shaft sleeve to the brush tip which is sandwiched between the inner shoulder portion of the front shaft and a front-end surface of the pipe-connecting piece, the improvement exists in that: the pipe-connecting piece is provided with a front resilient projection in its front-end surface, which projection resiliently deform to reduce a pressure applied to the solid flange portion of the brush tip.

3 Claims, 2 Drawing Sheets

LIQUID APPLICATOR WITH RESILIENT BRUSH MOUNTING

BACKGROUND OF THE INVENTION

1. Field of the Invention

The present invention relates to a liquid applicator such as: cosmetic instruments comprising eyeliner brushes and nail-polish applicators; writing instruments comprising writing brushes; and liquid-drug applicators. Incidentally, in the following description, the term "application" includes the concept of "writing".

2. Description of the Prior Art

As shown in FIG. 6, hitherto, in a conventional liquid applicator provided with a brush tip 1 for applying an application liquid such as nail polish and the like, the brush tip 1 is constructed of a tuft of fibers, a rear-end portion of which tuft is so heated and compressed as to be partially fused and formed into a solid flange portion 2 of the tuft or brush tip 1 after cooling. The brush tip 1 is fixedly mounted in a front shaft 3 of the liquid applicator in which the solid flange portion 2 of the brush tip 1 is firmly sandwiched between: an inner shoulder portion 4 of the front shaft 3; and a front-end surface of a pipe-connecting piece 6 having been fixed to a main body or shaft sleeve of the liquid applicator. The pipe-connecting piece 6 is provided with an axial through-hole in its central portion, in which axial through-hole a guide pipe 5 is fixedly mounted so as to extend forward from the front-end surface of the pipe-connecting piece 6. In assembling of the liquid applicator, the brush tip 1 is first inserted into the front shaft 3 to form a front shaft assembly (1, 3), while the pipe-connecting piece 6 is inserted into a front-end opening of the main body or shaft sleeve of the liquid applicator to form a shaft sleeve assembly. After that, the thus assembled front shaft assembly (1, 3) is threadably connected with the shaft sleeve assembly so that the entire rear-end surface of the solid flange portion 2 of the brush tip 1 abuts on the entire front-end surface of the pipe-connecting piece 6. At the same time, an extended portion of the guide pipe 5 having been fixedly mounted in the pipe-connecting piece 6 is inserted into a central axial hole of the brush tip 1, as shown in FIG. 6.

Since the conventional liquid applicator having the above construction has the entire rear-end surface of the brush tip 1 abut on the entire front-end surface of the pipe-connecting piece 6, there is a fear that the solid flange portion 2 of the brush tip 1 is not adequately sandwiched between: the inner shoulder portion 4 of the front shaft 3., and the front-end surface of the pipe-connecting piece 6 when the thickness of the solid flange portion 2 of the brush tip 1 varies. Namely, in case that the solid flange portion 2 of the brush tip 1 is less in thickness than a predetermined value, it is impossible to firmly sandwich the brush tip 1 between the inner shoulder portion 4 of the front shaft 3 and the front-end surface of the pipe-connecting piece 6. In contrast with this, in case that the solid flange portion 2 of the brush tip 1 is more in thickness than the predetermined value, there a fear that the solid flange portion 2 of the brush tip 1 is excessively pressed between the inner shoulder portion 4 of the front shaft 3 and the front-end surface of the pipe-connecting piece 6 so as to be broken. These are problems inherent in the conventional liquid applicator.

SUMMARY OF THE INVENTION

It is an object of the present invention to provide a liquid applicator provided with a brush tip for applying an application liquid such as nail polish, which brush tip is firmly and adequately mounted in the liquid applicator without a fear that a solid flange portion of the brush tip is loosely mounted or excessively pressed and broken even if the solid flange portion of the brush tip is varies in thickness.

The above object of the present invention is accomplished by providing:

In a liquid applicator comprising: a main body or shaft sleeve; a front shaft provided with at least one inner shoulder portion, the front shaft being fixedly mounted on the shaft sleeve; a brush tip for applying an application liquid, which brush tip has its rear-end portion formed into a solid flange portion, the brush tip being constructed of a tuft of fibers while mounted in the front shaft so as to extend forward from the front shaft; and a pipe-connecting piece provided with an axial through-hole in its central portion, in which through-hole is fixedly mounted a guide pipe for supplying the application liquid from the shaft sleeve to the brush tip which is sandwiched between the inner shoulder portion of the front shaft and a front-end surface of the pipe-connecting piece, the improvement wherein: the pipe-connecting piece is provided with a front resilient projection in its front-end surface.

In the liquid applicator of the present invention, the front resilient projection of the pipe-connecting piece may be constructed of an annular ridge or a plurality of needle-like projecting elements.

DESCRIPTION OF THE PREFERRED EMBODIMENTS

Now, embodiments of a liquid applicator or nail-polish applicator of the present invention will be hereinbelow described in detail with reference to the accompanying drawings.

Figure 1:
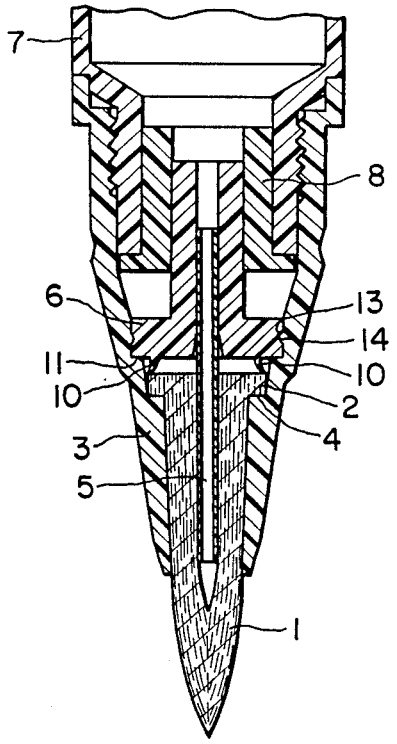
FIG. 1 is a longitudinal sectional view of an essential part of a first embodiment of the liquid applicator or nail-polish applicator of the present invention.
Figure 2:
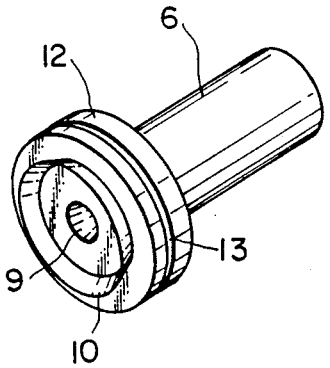
FIG. 2 is a perspective view of the pipe-connecting piece employed in the first embodiment of the liquid applicator of the present invention shown in FIG. 1.

FIGS. 1 and 2 show a first embodiment of a liquid applicator or nail-polish applicator of the present invention, in which applicator: a pipe-connecting piece supporting member 8 is press-fitted to a front-end opening of a main body or shaft sleeve 7 of the nail-polish applicator, and then a pipe-connecting piece 6 is press-fitted to the supporting member 8. As shown in FIG. 2, in a front-end surface of the pipe-connecting piece 6 is provided a resilient annular ridge portion 10 which is coaxially arranged with a central axial through-hole 9 of the pipe-connecting piece 6.

A guide pipe 5 for supplying an application liquid such as nail polish from the shaft sleeve 7 to a brush tip 1 of the applicator is fixedly mounted in the axial through-hole 9 of the pipe-connecting piece 6 so as to have its front portion axially extend forward from a front-end surface of the pipe-connecting piece 6.

The brush tip 1 is constructed of a tuft of fibers, a rear-end portion of which tuft is so heated and compressed as to be partially fused and formed into a disk-like solid flange portion 2 of the tuft or brush tip 1 after cooling. In assembling operation of the applicator, the brush tip 1 is inserted into the front shaft 3 to cause a front-end surface of the solid flange portion 2 of the brush tip 1 to abut on a first inner shoulder portion 4 of the front shaft 3. As a result, a front-end portion of the brush tip 1 axially extends forward from a front end of the front shaft 3.

The front shaft 3 is threadably engaged with an outer peripheral surface of a front-end portion of the shaft sleeve 7 of the nail-polish applicator.

The front shaft 3 is further provided with a second inner shoulder portion 11 in its inner surface at a position behind the first inner shoulder portion 4. In the front shaft 3, further provided in its inner surface at a position behind the second inner shoulder portion 11 is an annular ridge portion 14. An outer peripheral edge portion of the pipe-connecting piece 6 abuts on the second inner shoulder portion 11 of the front shaft 3. On the other hand, an annular groove 13 is formed in an outer peripheral surface of a front-end disk portion 12 of the pipe-connecting piece 6, and engages with the annular ridge portion 14 of the front shaft 3 so that the pipe-connecting piece 6 is fixedly mounted in a predetermined position of the front shaft 3.

Under such circumstances, the resilient annular ridge portion 10 of the pipe-connecting piece 6 is resiliently pressed against a rear-end surface of the solid flange portion 2 of the brush tip 1 to enable the brush tip 1 to be firmly mounted in the front shaft 3.

Figure 3:
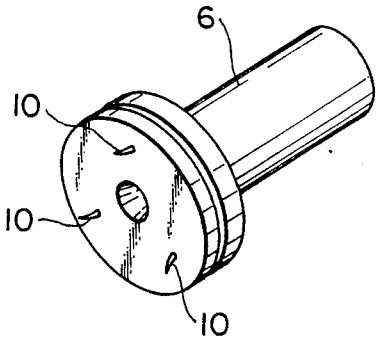
FIG. 3 is a perspective view of the pipe-connecting piece employed in a second embodiment of the liquid applicator of the present invention.

FIG. 3 shows a second embodiment of the pipe-connecting piece 6 of the liquid applicator or nail-polish applicator of the present invention. In this second embodiment, the resilient annular ridge portion 10 of the first embodiment of the pipe-connecting piece 6 shown in FIG. 1 is replaced with a plurality of resilient needle-like projecting elements 10 as shown in FIG. 3, which needle-like projecting elements 10 are provided in the front-end surface of the pipe-connecting piece 6 as shown in FIG. 3. The number of the needle-like projecting elements 10 of the second embodiment of the pipe-connecting piece 6 is not limited In other words, any number of needle-like projecting elements 10 are employed in the second embodiment of the pipe-connecting piece 6 of the applicator of the present invention.

Figure 4:
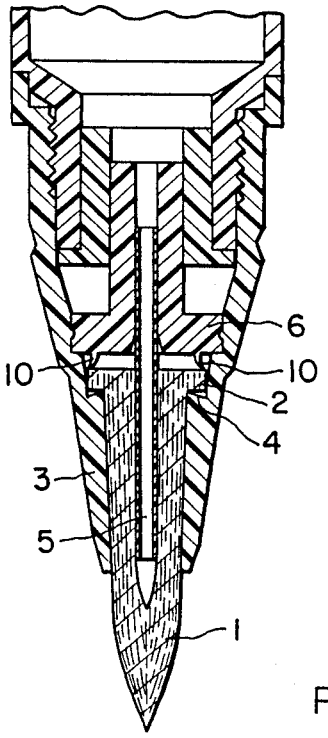
FIG. 4 is a longitudinal sectional view of an essential part of a third embodiment of the liquid applicator or nail-polish applicator of the present invention.

FIG. 4 shows a third embodiment of the liquid applicator or nail-polish applicator of the present invention, in which third embodiment the inner shoulder portion 4 of the front shaft 3 is tapered to have a tapered shoulder surface 4 shown in FIG. 4, so that the brush tip 1 and the front shaft 3 reduce their coengaging surface portion.

Figure 5:
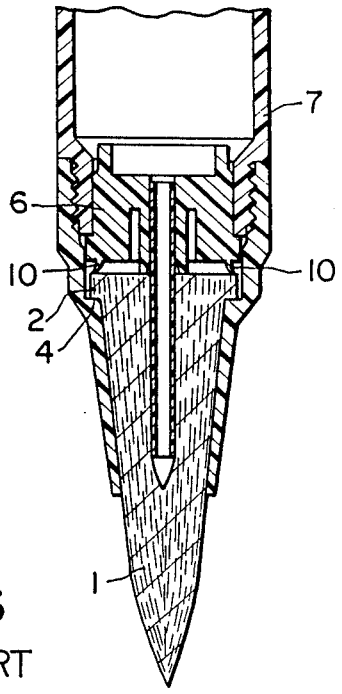
FIG. 5 is a longitudinal sectional view of an essential part of a fourth embodiment of the liquid applicator or nail-polish applicator of the present invention.
Figure 6:
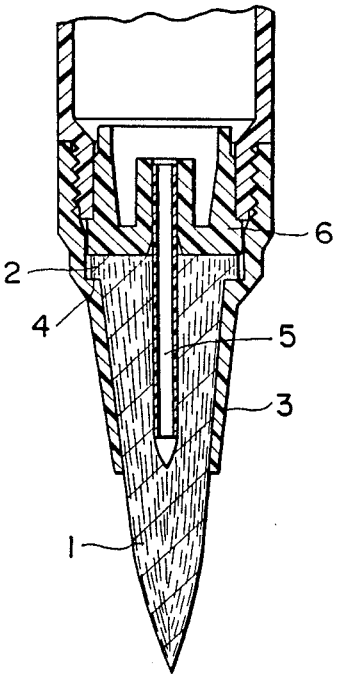
FIG. 6 PRIOR ART
FIG. 6 is a longitudinal sectional view of an essential part of the conventional liquid applicator or conventional nail-polish applicator.

FIG. 5 shows a fourth embodiment of the liquid applicator or nail-polish applicator of the present invention, in which the pipe-connecting piece 6 is fixedly mounted on the shaft sleeve 7 directly. In each of the above third and fourth embodiments of the applicator of the present invention, the front resilient projection 10 of the pipe-connecting piece 6 may be constructed of the resilient annular ridge 10 or the plurality of the resilient needle-like projecting elements 10.

In the applicator of the present invention having the above construction, since variation in thickness of the solid flange portion 2 of the brush tip 1 simply causes the front resilient projection 10 of the pipe-connecting piece 6 to resiliently deform so that the projection 10 is still resiliently pressed against the rear-end surface of the solid flange portion 2 of the brush tip 1, it is possible to firmly mount the brush tip 1 in the front shaft 3 even if the solid flange portion 2 of the brush tip 1 varies in thickness. In addition, the front resilient projection 10 of the brush tip 1 may reduce a pressure applied to the solid flange portion 2 of the brush tip 1 to present the solid flange portion 2 of the brush tip 1 from being damaged by an excessive pressure applied thereto.

What is claimed is:

1. In a liquid applicator comprising a main body or shaft sleeve., a front shaft provided with at least one inner shoulder portion, said front shaft being fixedly mounted on said shaft sleeve; a brush tip for applying an application liquid, which brush tip has its rear-end portion formed into a solid flange portion, said brush tip being constructed of a tuft of fibers while mounted in said front shaft so as to extend forward from said front shaft; and a pipe-connecting piece provided with an axial through-hole in its central portion, in which through-hole is fixedly mounted a guide pipe for supplying said application liquid from said shaft sleeve to said brush tip which is sandwiched between said inner shoulder portion of said front shaft and a front-end surface of said pipe-connecting piece, the improvement wherein: said pipe-connecting piece is provided with a front resilient projection in its front-end surface.

2. The liquid applicator as set forth in claim 1, wherein:

said front resilient projection of said pipe-connecting piece is constructed of an annular ridge.

3. The liquid applicator as set forth in claim 1, wherein:

said front resilient projection of said pipe-connecting piece is constructed of a plurality of needle-like projecting elements.

* * * * *